US005092150A

United States Patent [19]

Cunningham

[11] Patent Number: 5,092,150

[45] Date of Patent: Mar. 3, 1992

[54] PIPE TRANSPORT MECHANISM FOR PIPE BENDER

[75] Inventor: Joseph A. Cunningham, Broken Arrow, Okla.

[73] Assignee: CRC-Evans Pipeline International, Inc., Houston, Tex.

[21] Appl. No.: 732,588

[22] Filed: Jul. 19, 1991

[51] Int. Cl.[5] ..... B21D 9/05

[52] U.S. Cl. ..... 72/369; 72/308; 72/388; 72/466

[58] Field of Search ..... 72/308, 369, 388, 392, 72/398, 466

[56] References Cited

U.S. PATENT DOCUMENTS

| | | | |
|---|---|---|---|
| 3,406,551 | 10/1968 | Coody | 72/388 |
| 3,705,506 | 12/1972 | Clavin et al. | 72/406 |
| 3,834,210 | 12/1974 | Clavin et al. | 72/388 |
| 3,851,519 | 12/1974 | Calvin et al. | 72/466 |
| 4,122,697 | 10/1978 | Hanyo et al. | 72/369 |
| 4,313,330 | 2/1982 | Cummings | 72/388 |
| 4,412,442 | 11/1983 | Kawanami et al. | 72/369 |

*Primary Examiner*—David Jones

*Attorney, Agent, or Firm*—Richards, Medlock & Andrews

[57] ABSTRACT

A transport mechanism (28) is disclosed for use in a pipe bender (10) for bending pipe sections (12), particularly pipe sections having a diameter greater than one foot. First and second powered rollers (30, 32) are mounted within the pipe bender and driven by hydraulic motors to move the pipe section in a controlled manner through the pipe bender. A hold down roller (34) is pivoted against the pipe section to force the pipe section into engagement with the powered rollers to insure an adequately frictional engagement between the rollers and the pipe section to move the pipe section through the pipe bender.

8 Claims, 3 Drawing Sheets

PIPE TRANSPORT MECHANISM FOR PIPE BENDER

TECHNICAL FIELD OF THE INVENTION

This invention relates to the bending of pipe, particularly larger diameter pipe having a diameter of a foot or more

BACKGROUND OF THE INVENTION

A pipeline must, to some degree, follow the contour of the land through which the pipeline is laid. This is particularly true with underground pipe, which is becoming evermore prevalent. For example, a pipe passing under a ravine must often have an appropriate bend to accommodate the ravine. With the ever increasing density of pipelines crossing the country, it is sometimes necessary for a section of pipeline to be bent to avoid interfering with another pipeline.

Portable pipe bending machines have been developed which permit the bending of a length of pipe to the proper degree at the site of installation. Examples of such benders are disclosed in U.S. Pat. No. 3,834,210 issued on Sept. 10, 1974 to Clavin, et al. and U.S. Pat. No. 3,851,519 issued Dec. 3, 1974 to Clavin et al.

The typical pipe section delivered from the factory has a length between 40 and 80 feet. Most common is a 40 foot length, or an 80 foot length normally formed by welding two 40 foot sections together at the factory. These pipe sections must be inserted into the pipe bender to the appropriate location to create the bend. Depending on circumstances, a number of bends may be made in a single pipe section to create a desired final curvature. Conventional wisdom suggests that bends in a pipe section should be made about 12–14 inches apart (although successful bending has been done in ranges from 11" to 18"), with a winch and cable apparatus employed to move the pipe section after each bending operation. The procedure is time consuming and requires skilled operators. There is a need to make this bending process more efficient and less complex for the operator.

SUMMARY OF THE INVENTION

In accordance with one aspect of the present invention, an apparatus forming an improvement in a pipe bender is provided. The pipe bender is used for bending a length of pipe and has a bending die, a pin up shoe and a stiffback. The apparatus includes a first powered roller mounted on the pipe bender proximate a first end of the pipe bender and a second powered roller mounted on the pipe bender proximate a second end of the pipe bender. A hold down roller is mounted to the pipe bender for movement between a pipe release position and a pipe engagement position. Structure is provided for moving the hold down roller between the two positions and structure is provided to power the first and second rollers to move the pipe through the pipe bender. In the pipe engagement position, the hold down roller forces the pipe against at least one of the powered rollers to insure frictional engagement between the rollers in the pipe to facilitate the pipe movement.

In accordance with another aspect of the present invention, the hold down roller is pivotally mounted to the pipe bender. The pipe bender includes a winch for conventional movement of the pipe section and the hold down roller is configured to prevent interference with the operation of the winch.

BRIEF DESCRIPTION OF THE DRAWINGS

With reference now to the following detailed description, taken in conjunction with the accompanying drawings, wherein.

Figure 3:
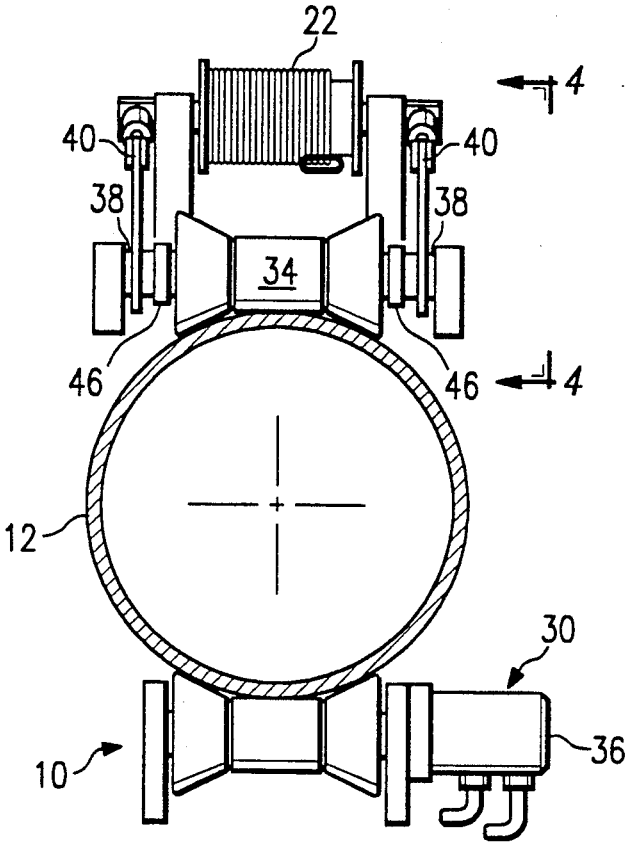

FIGS. *2a–c* are illustrative views of a pipe bender using the prior art winch mechanism to move the pipe section within the bender;

FIG. 3 is a front view of the pipe bender; and

Figure 4:
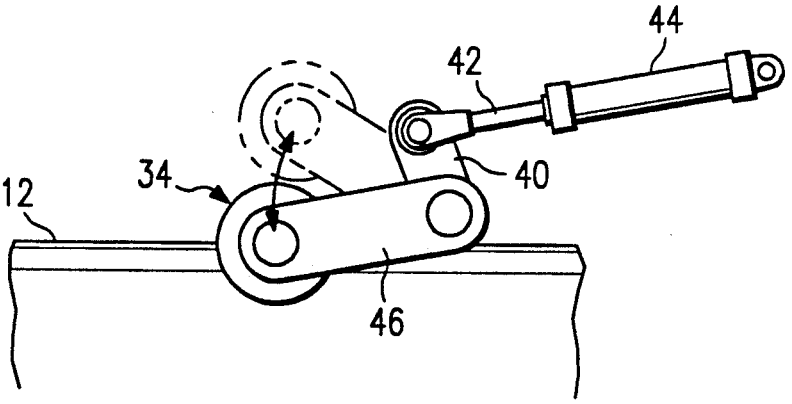

FIG. 4 is a side view of a portion of the pipe bender taken along line 4—4 in FIG. 3 in the direction of the arrows.

DETAILED DESCRIPTION

Figure 1:
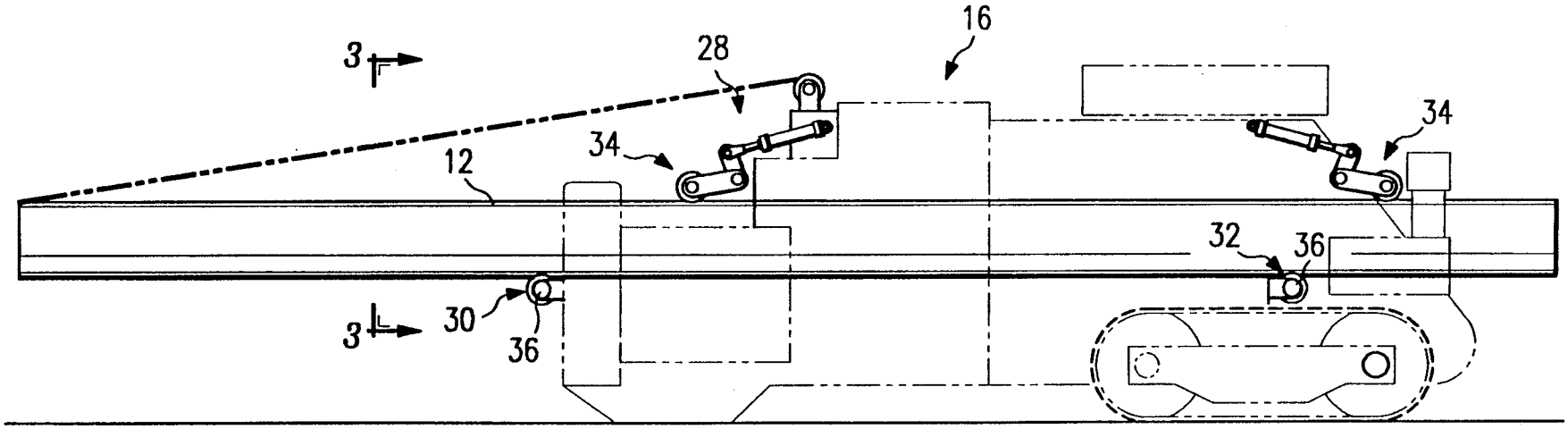
FIG. 1 is a side view of a pipe bender incorporating a first embodiment of the present invention with a pipe section about to be inserted into the bender.
Figure 2A:
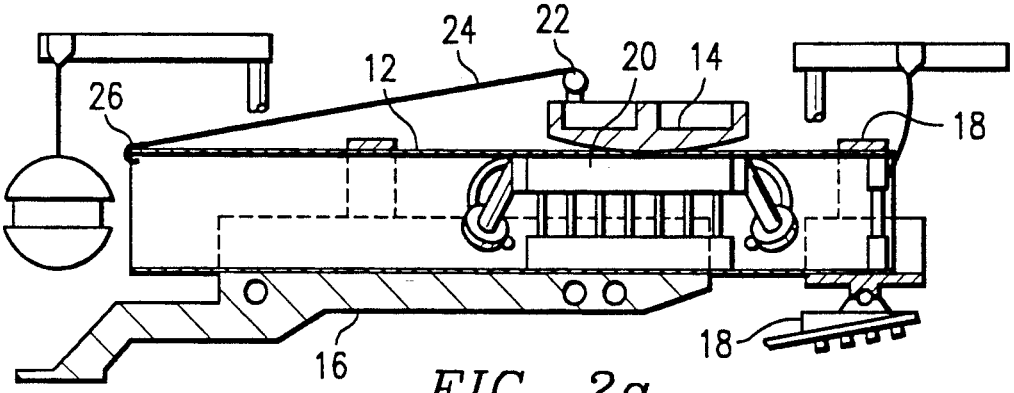
Figure 2B:
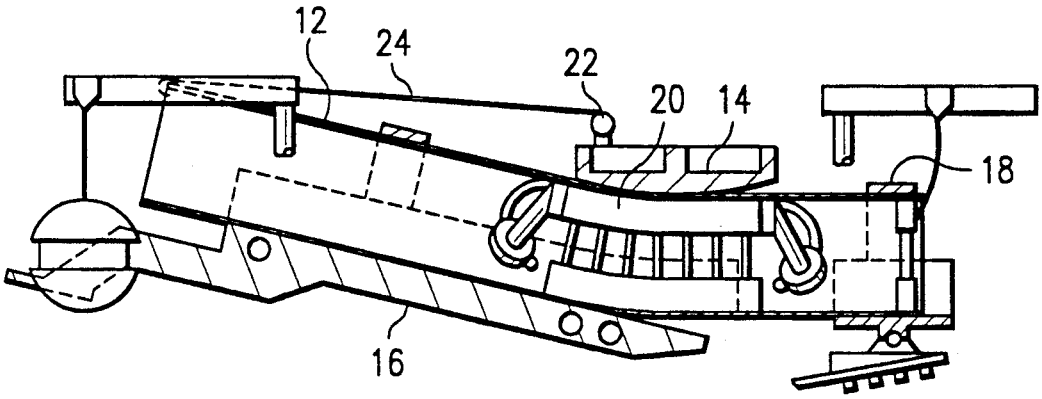
Figure 2C:
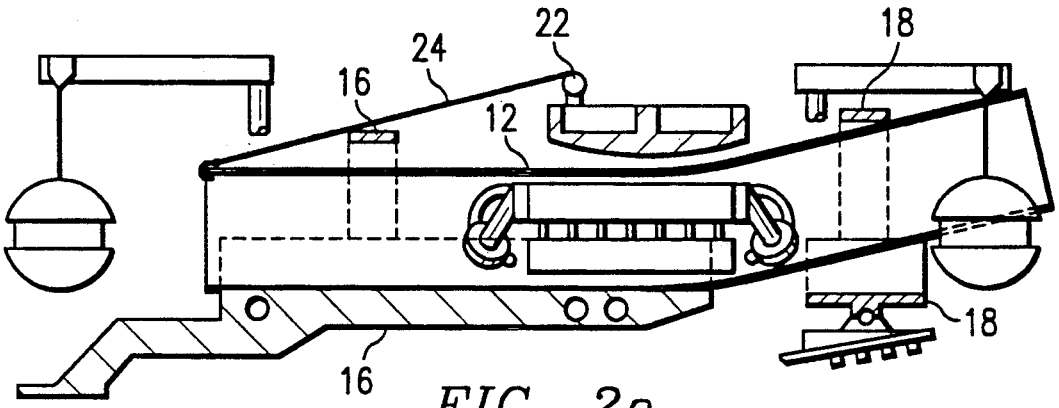

With reference now to the drawings, wherein like reference numerals designate like or corresponding parts throughout the several views, there is illustrated in FIGS. 1–3 a pipe bender 10. Such a pipe bender is disclosed in U.S. Pat. No. 3,834,210 which is hereby incorporated by reference in its entirety, and U.S. Pat. No. 3,851,519 also hereby incorporated by reference in its entirety.

The pipe bender 10 is used to bend a pipe section 12 into a desired curvature by the use of hydraulic forces. More specifically and as best seen in FIGS. *2a–c,* it can be observed that the pipe bending machine bends pipe by securing the pipe section between the cooperating bending die 14, stiffback 16 and pin up shoe 18. A length of pipe section 12 is inserted in the pipe bender from the rear end 21 of the bender, over the pin up shoe 18 and onto the stiffback 16 as illustrated in FIG. *2a.* Powerful hydraulic cylinders on the bender are activated to bend the pipe about the bending die 14 by moving the front end of stiffback 16 upwardly. The pin up shoe 18 acts as the fulcrum or support for the rearward end of the pipe section to prevent it from moving downward. Normally, an internal pipe bending mandrel 20 is inserted within the pipe section to be bent at the point of the bend. The mandrel supports the inner walls of the pipe to insure the bend does not collapse the walls.

Also with reference to FIGS. *2a–c,* the traditional mechanism for moving the pipe section within the pipe bender 10 is illustrated. This includes a winch 22 with a cable 24 extending to one end of the pipe section. The end of cable 24 has a U clamp 26 which fits over the end of the pipe section. As the winch reels in the cable 24, the pipe section is moved from left to right in FIGS. *2a–c.*

Each pipe section must be bent specifically for its application. Each bend put in the pipe section by the pipe bender is limited to a certain number of degrees to avoid damage to the pipe section. Thus, if a greater curvature is required in the specific pipe section than is possible in a single bending operation, the pipe section will have to be bent at a number of locations along its length to provide the desired final curvature. It is conventionally understood that these bends should be made about 14 inches apart although separations in a range between 11" and 18" are used. FIG. *2c* illustrates the pipe moved after one bend into a position for the second bend.

Most pipe sections come in a length between 40 to 80 feet, with one standard length being 40 feet or an assembly of two pipe sections welded together at the factory with a total length of 80 feet. The pipe section 12 will be initially inserted within the pipe bender by a lifting device such as a side boom tractor. In the traditional designs, the cable 24 was paid out to clamp the end of the pipe section 12 and the pipe section was then moved through the bender as needed to make the bends.

With reference now to FIGS. 1, 3 and 4, a first embodiment of the present invention is illustrated and comprises transport mechanism 28. The mechanism 28 includes a first powered roller 30, a second power roller 32, a hold down roller 34 and the equipment necessary to operate these rollers as will be discussed hereafter.

The first powered roller 30 is mounted to the pipe bender 10 at the front of the stiffback. The roller includes a reversible hydraulic motor 36 which allows the roller to be rotated in either direction using the hydraulic power source on the pipe bender. The second powered roller 32 is mounted on the pipe bender between the stiffback 16 and the pin up shoe 18. A reversible hydraulic motor 36 is also associated with the roller 32 and is powered by the hydraulic system of the pipe bender. Preferably, both motors 36 on the roller 30 and 32 are tied to the same control system so that the rollers will rotate in the same direction and at the same speed at all times. While the rollers are described and illustrated to be mounted at specific positions on the pipe bender, and specifically below the pipe section to be bent to support the pipe section, these rollers can be located at other positions in the bender provided the advantages of the transport mechanism 28 are still realized.

The hold down roller 34 includes a cross shaft 38 which is pivoted across the width of the pipe bender proximate the location of the winch 22. Near each end of the cross shaft 38 is a cylinder arm 40 which is pivotally attached to the piston rod 42 of a double acting hydraulic cylinder 44. Inboard of the arms 40 are cylinder arms 46 which pivotally secure the roller 34 between the arms for free rotation. As can be seen in FIG. 3, the hydraulic cylinders 44 can be activated to pivot the hold down roller into engagement with the upper surface of the pipe section. The engagement is with sufficient force to cause the pipe section to come into intimate contact with at least one of the powered rollers 30 or 32 to insure an adequate frictional engagement between the powered rollers and the pipe section so that rotation of the powered rollers will translate the pipe section linearly through the pipe bender.

The operator can activate the power rollers to move the pipe section within the pipe bender precisely to the position for each bend. If the pipe section overshoots the desired mark, the rollers can be powered in reverse to properly position the pipe section. This advantage could not be realized with the single cable and winch illustrated in FIGS. *2a–c* as that assembly could effectively move the pipe section in only one direction through the pipe bender. Even so, the hold down roller 34 is configured to permit conventional use of the winch and cable if desired.

In one embodiment constructed in accordance with the teachings of the present invention, the pipe bender was designed to bend pipe in the range of 22–36 inches in diameter. Certainly, the advantages of the present invention would be expected to be useful in bending pipe of conventional diameters between 6 inches and 60 inches. Each of the rollers 30–34 had a polyurethane surface in contact with the pipe section for adequate frictional engagement with the pipe section. However, other suitable materials could be used, such as rubber.

The three rollers 30–34 are preferably spaced along the length of the pipe bender to provide a three point engagement with the pipe section to keep the center line of the pipe section aligned with the center line of the die bender. While a single powered roller in contact with the pipe section could move the pipe section, the design illustrated in the figures and described previously is preferred. Further, the hold down roller can also be powered. In such a design, the rollers 30 and 32 can remain powered, or can be made unpowered idler rollers.

It may also be desirable to mount a second hold down roller 134 (as seen in FIG. 1) on the pipe bender 10 between the die 14 and the pin up shoe 18. This roller 134 can be powered, or not. Since the bend in the pipe section can tend to lift the pipe section off of the roller 32, the roller 134 can be used to force the pipe section downward into engagement with roller 32.

While one embodiment of the present invention has been described in detail herein and shown in the accompanying drawings, it will be evident that further modifications or substitutions of parts and elements are possible without departing from the scope and spirit of the invention.

I claim:

1. An apparatus for use in a pipe bender, the pipe bender for bending a length of pipe and having a bending die, a pin up shoe and a stiff back, the apparatus comprising:

a first powered roller mounted on the pipe bender proximate a first end of the pipe bender;

a second roller mounted on the pipe bender proximate a second end of the pipe bender;

a hold down roller mounted to said pipe bender for movement between a pipe release position and a pipe engagement position;

means for pivoting the hold down roller between the pipe release position and the pipe engagement position; and means to power at least said first powered roller to move the pipe through the pipe bender.

2. The apparatus of claim 1 wherein said second roller is also powered.

3. The apparatus of claim 1 having a portion in contact with the pipe, said portion formed of polyurethane.

4. The apparatus of claim 1 having a portion in contact with the pipe, said portion formed of rubber.

5. The apparatus of claim 1 wherein the pipe bender further comprises a winch for moving the pipe through the pipe bender, said hold down roller positioned on said pipe bender to prevent interference with operation of the winch.

6. A method for positioning a pipe section within a pipe bender for bending, the pipe bender including a bending die, a pin up shoe and a stiffback, the method comprising the steps of:

engaging the pipe section with a first powered roller mounted on the pipe bender;

moving a hold down roller from a pipe release position to a pipe engagement position whereby the pipe section is urged against the first powered roller;

operating the first powered roller to move the pipe section through the pipe bender to the desired location for a bend.

7. The method of claim 6 further comprising the step of engaging a second powered roller mounted on the pipe bender to the pipe section and powering said second powered roller to move the pipe section through the pipe bender.

8. The method of claim 7 further comprising the step of positioning said first and second powered rollers and said hold down roller at separate locations along the length of the pipe bender to constrain the pipe section to the proper position for bending.

* * * * *